US007140937B2

(12) United States Patent
Cadorette

(10) Patent No.: US 7,140,937 B2
(45) Date of Patent: Nov. 28, 2006

(54) SWIM FIN WITH DETACHABLE BLADE

(76) Inventor: Ron Cadorette, 485 Viceroy Road, North Bay, Ontario (CA) P1B 8G4

( * ) Notice: Subject to any disclaimer, the term of this patent is extended or adjusted under 35 U.S.C. 154(b) by 0 days.

(21) Appl. No.: 11/108,697

(22) Filed: Apr. 19, 2005

(65) Prior Publication Data

US 2006/0234570 A1 Oct. 19, 2006

(51) Int. Cl.
*A63B 31/08* (2006.01)

(52) U.S. Cl. ..... 441/64

(58) Field of Classification Search ..... 441/64
See application file for complete search history.

(56) References Cited

U.S. PATENT DOCUMENTS

| | | | | |
|---|---|---|---|---|
| 3,171,142 | A | 3/1965 | Auzols | |
| 3,268,927 | A | 8/1966 | Markowitz | |
| 3,302,223 | A | 2/1967 | Ciccotelli | |
| 3,315,286 | A | 4/1967 | Brion | |
| 4,017,925 | A | 4/1977 | Shamlian | |
| 4,025,977 | A | 5/1977 | Cronin | |
| 4,178,128 | A | 12/1979 | Gongwer | |
| 4,944,703 | A | 7/1990 | Mosier | |
| 4,981,454 | A | 1/1991 | Klein | |
| 5,083,954 | A | 1/1992 | Jacobs | |
| 5,151,060 | A | 9/1992 | Lam | |
| 5,163,859 | A | 11/1992 | Beltrani et al. | |
| 5,324,219 | A | 6/1994 | Beltrani et al. | |
| 5,447,457 | A | 9/1995 | Kamitani | |
| 5,632,662 | A * | 5/1997 | Cadorette | 441/63 |
| 5,820,428 | A | 10/1998 | Stadler | |
| 6,290,560 | B1 | 9/2001 | Kidd et al. | |
| 2005/0153607 | A1 * | 7/2005 | Burns et al. | 441/63 |

FOREIGN PATENT DOCUMENTS

| | | |
|---|---|---|
| DE | 40 20 235 A 1 | 6/1990 |
| FR | 72.05816 | 9/1973 |

* cited by examiner

*Primary Examiner*—Stephen Avila
(74) *Attorney, Agent, or Firm*—Merek, Blackmon, & Voorhees, LLC

(57) ABSTRACT

A swim fin comprising a foot engaging portion and a blade portion. The blade portion includes one or more first latching members and the foot engaging portion includes one or more second latching members. The first and said second latching members together form one or more releasable latching mechanisms permitting the blade portion to be releasably secured to the foot engaging portion.

14 Claims, 10 Drawing Sheets

SWIM FIN WITH DETACHABLE BLADE

FIELD OF THE INVENTION

This invention relates to a swim fin, and in particular to a swim fin with a detachable blade portion.

BACKGROUND OF THE INVENTION

Swim fins are typically worn by swimmers and those engaged in snorkelling and scuba diving in order to provide a means to increase their rate of propulsion through the water. Most commonly swim fins comprise a blade or web portion that is either fixed to a boot that may worn by the swimmer or that is otherwise attachable to a swimmer's foot. The blade on the fin increases the amount of water that is displaced during a kicking movement and thereby increases the acceleration and propulsion of the swimmer through the water.

Traditionally, swim fins have been designed with the blade or web portion rigidly fixed to a boot or toe portion that is attachable to a swimmer's foot. More recently, articulated swim fins have been developed, such as those described in U.S. Pat. No. 5,632,662, dated May 27, 1997. In that patent there is described a fin wherein the blade or web portion is pivotable about a hinge joint on the boot in order to allow for forward propulsion during a kicking movement, while at the same time relieving the stress and strain that would otherwise be applied to the ankle and foot of the swimmer through the use of a traditional fixed blade fin. While such fins may be advantageous in terms of relieving muscle strain and fatigue of the ankle joint, they nevertheless suffer from a common and inherent limitation associated with fins having blade portions that are permanently secured to a boot portion.

Swim fins, whether they be traditional swim fins or more recently developed centrally articulated fins, are clumsy and difficult to manipulate when walking on land. Previous attempts to design a swim fin that allows a swimmer to more easily walk on land have met with only limited success and have focussed upon the use of relatively complex mechanical structures that permit the blade or web portion of the fin to pivot upwardly to a position above the swimmer's foot (for example see U.S. Pat. No. 4,981,454, dated Jan. 1, 1991). Such fins are not only more mechanically complex, and as a result more prone to failure, but are also generally more expensive to manufacture and often enhance the ease of a swimmer to walk on dry land at the expense of comfort and simplicity of use.

SUMMARY OF THE INVENTION

The invention therefore provides a swim fin that both enhances the ability for a swimmer to propel himself or herself through the water, while at the same time through the use of a mechanism that permits the detachment of the blade or web portion allows the swimmer to easily and comfortably walk upon dry land.

Accordingly, in one of its aspects the invention provides a swim fin comprising a foot engaging portion and a blade portion, said blade portion including one or more first latching members and said foot engaging portion including one or more second latching members, said first and said second latching members together forming one or more releasable latching mechanisms permitting said blade portion to be releasably secured to said foot engaging portion.

In a further aspect the invention provides a swim fin comprising a foot engaging portion; a blade having a pair of arms, said arms releasably securable to opposite sides of said foot engaging portion; and, first and second latching mechanisms on each side of said foot engaging portion, said first and second latching mechanisms releasably engagable to secure said arms of said blade to opposite sides of said foot engaging portion.

In another aspect the invention concerns a swim fin comprising a foot engaging portion; a blade having a pair of arms, said arms releasably securable to said foot engaging portion; and, a pair of first and second latching members releasably engagable to secure said arms of said blade to said foot engaging portion, said first latching members comprising one or more pins, posts or flanges and said second latching members comprising one or more recesses dimensioned to receive said one or more pins, posts or flanges when said blade is detachably secured to said foot engaging portion, said second latching members further including a ramp, said ramp causing a horizontally outward displacement of said arms upon the insertion of said foot engaging portion therebetween to facilitate the receipt of said one or more pins, posts or flanges within said recesses.

Further aspects and advantages of the invention will become apparent from the following description taken together with the accompanying drawings.

BRIEF DESCRIPTION OF THE DRAWINGS

For a better understanding of the present invention, and to show more clearly how it may be carried into effect, reference will now be made, by way of example, to the accompanying drawings which show the preferred embodiments of the present invention in which.

DESCRIPTION OF THE PREFERRED EMBODIMENT

The present invention may be embodied in a number of different forms. However, the specification and drawings that follow describe and disclose only some of the specific forms of the invention and are not intended to limit the scope of the invention as defined in the claims that follow herein.

Figure 1:
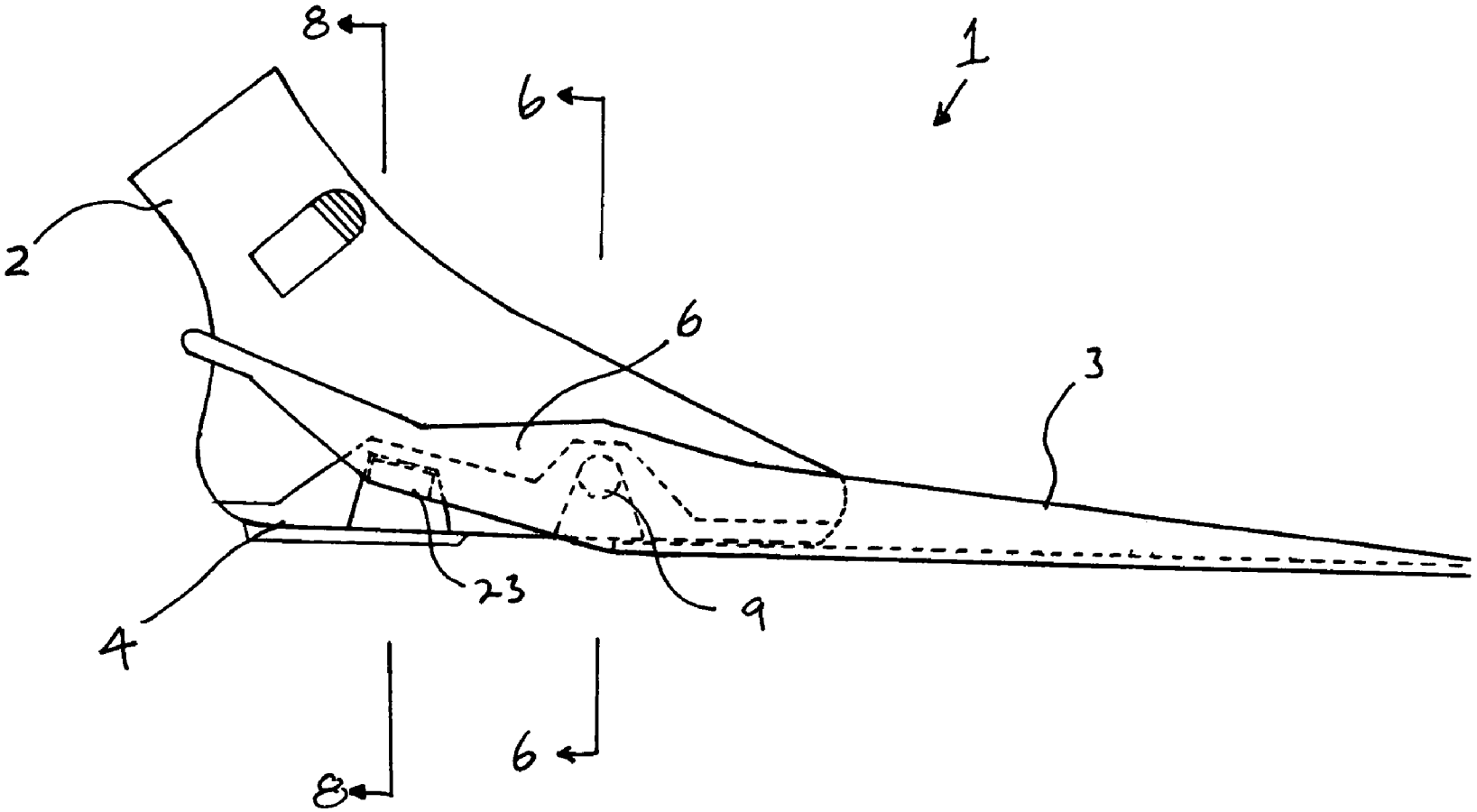
FIG. 1 is a side elevational view of a swim fin constructed in accordance with one of the preferred embodiments of the invention.
Figure 4:
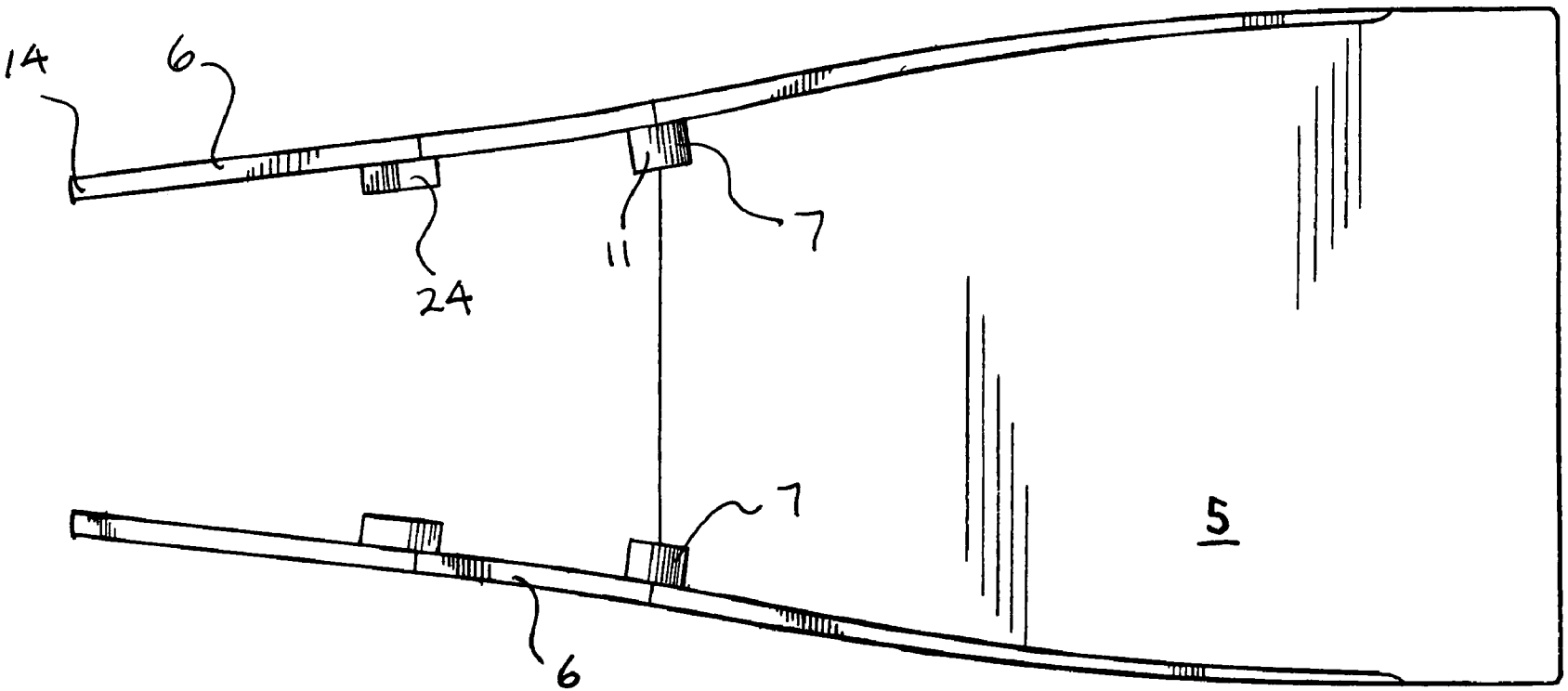
FIG. 4 is a plan view of the blade portion of the swim fin shown in FIG. 1 having been removed from the boot portion.
Figure 5:
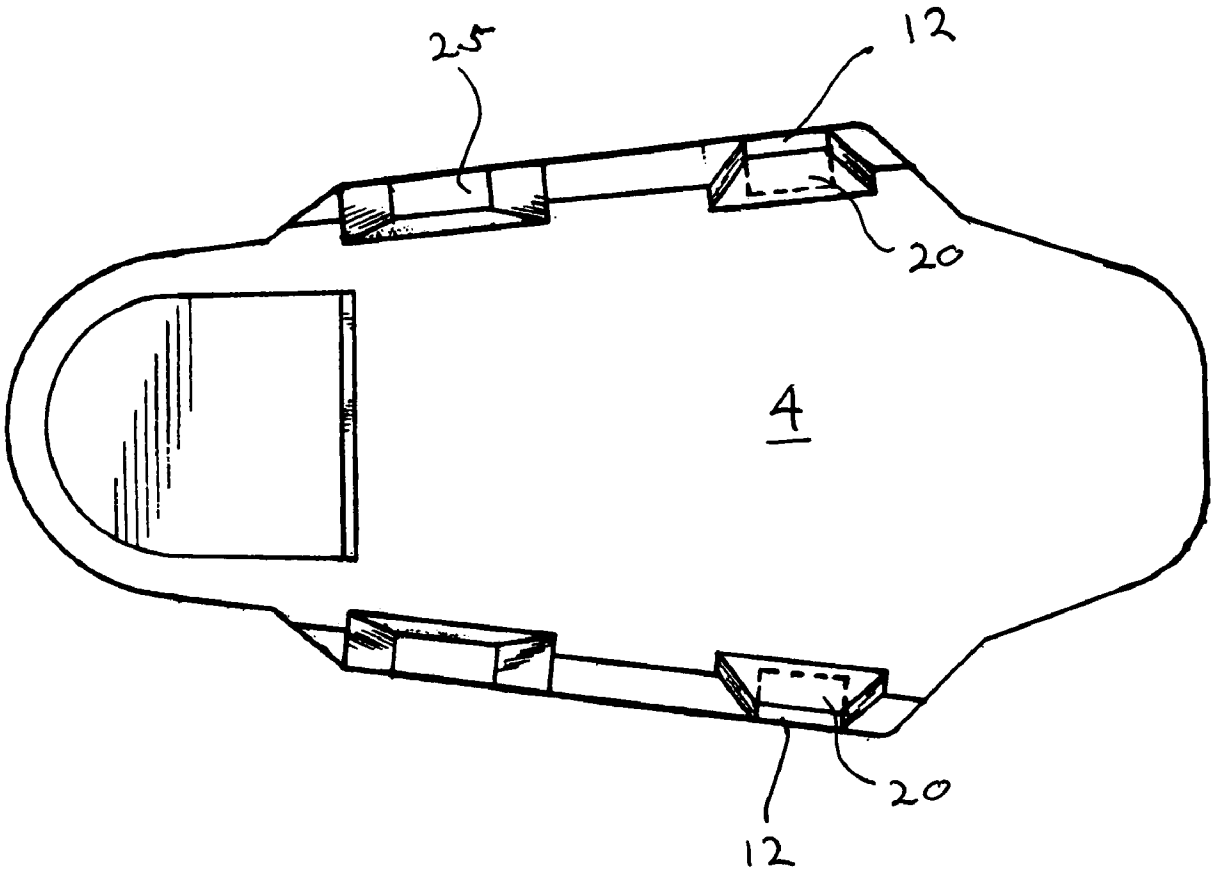
FIG. 5 is a bottom view of the boot portion of the swim fin shown in FIG. 1.

FIG. 1 shows a form of a swim fin having a detachable blade constructed in accordance with one of the preferred embodiments of the present invention. In FIG. 1 swim fin 1 is comprised generally of a foot engaging portion 2 and a blade portion 3. In this embodiment, foot engaging portion 2 is in the form of a standard boot-like structure, commonly used on many forms of swim fins. In alternate embodiments, the foot engaging portion could be comprised of a low-cut boot or an enclosed toe portion having a heel strap to secure the fin around the ankle of a swimmer. For reasons that will become apparent after a full and complete understanding of the invention, in the preferred embodiment foot engaging portion 2 is fitted with a rigid or semi-rigid bottom or sole 4 that may be comprised of any of a wide variety of plastics, nylons, rubber, thermoplastics, metals or other materials. Where foot engaging portion 2 is in the form of a boot, the upper part of the boot is preferably constructed from neoprene or a similar flexible material. As may be best seen in FIG. 4, blade portion 3 of fin 1 includes a typical webbed section 5 that has extending along each side an arm member 6. The web section 5 of blade 3 may be formed from a rubber or plastic material with arms 6 designed in a fashion that permits the insertion of bottom or sole 4 of foot engaging portion 2 between the respective arm members.

With reference to FIGS. 1 through 8, in accordance with the present invention blade portion 3 includes one or more first latching members 7 and foot engaging portion 2 includes one or more second latching members 8. In the embodiment of the invention shown in the attached drawings, first latching members 7 are positioned upon the inner surface 10 of arms 6 and second latching members 8 are located on opposite sides of foot engaging portion 2, preferably secured to bottom or sole 4. It should be noted that the relative positioning of first and second latching members on arms 6 and foot engaging portion 2 is such that when the foot engaging portion is received between the respective arm members, the first and second latching members on each side of the fin may engage together to form one or more releasable latching mechanisms 9. Releasable latching mechanisms 9 permit the blade portion to be releasably secured to the foot engaging portion.

Figure 2:
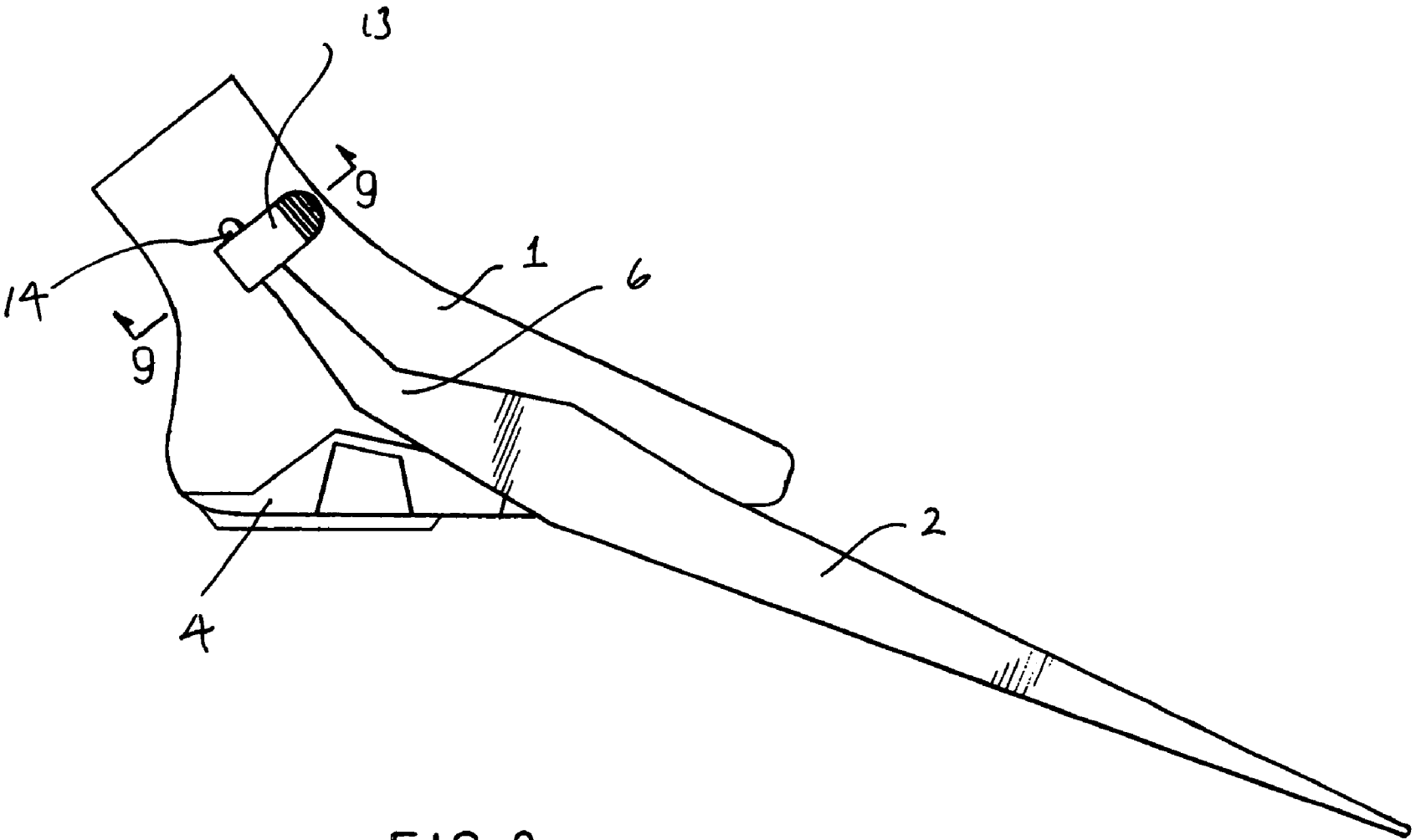
FIG. 2 is a side elevational view of the swim fin shown in FIG. 1 having its blade portion rotated to bring it more in-line with the lower portion of swimmer's leg.

First and second latching members 7 and 8 may take the form of a wide variety of different mechanical structures while still permitting the blade of the swim fin to be releasably secured to its foot engaging portion. In the embodiment of the invention shown in FIGS. 1 through 8, blade portion 3 is capable of rotating about the foot engaging portion to allow the blade to become positioned such that it is more parallel to the lower leg of the swimmer. A swim fin having a blade that rotates or pivots in a similar fashion is shown and described in the applicant's prior issued U.S. Pat. No. 5,632,662 dated May 27, 1997. In the attached drawings first latching members 7 on arms 6 are preferably comprised of one or more inwardly directed pins, posts or flanges. Second latching members 8 are preferably comprised of one or more outwardly extending open recesses 12 that are positioned on foot engaging portion 2 and dimensioned so as to receive the one or more inwardly directed pins, posts or flanges of first latching members 7 when the blade portion is releasably secured to the foot engaging portion. In this manner, with first latching members 7 received within the recesses comprising the second latching members, blade portion 3 is free to pivot about foot engaging portion 2 along an axis that is generally perpendicular to the axis of the lower portion of the swimmer's leg. FIG. 1 shows such a swim fin in a traditional configuration before blade portion 3 is rotated. FIG. 2 shows the same swim fin wherein blade portion 3 has been rotated to a point where it is more closely parallel to the swimmer's leg.

Figure 9A:
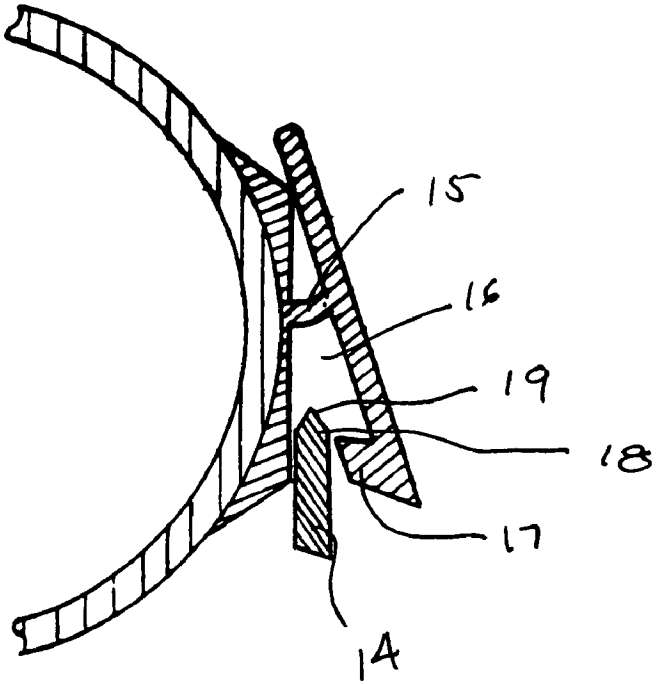
FIG. 9*a* is a scrap view of a portion of the device shown in FIG. 9 showing the upper end of one of the arms of the blade portion partially released from its locking clasp; and, FIG. 10 is a side elevational view of an alternate embodiment of a swim fin constructed in accordance with one of the preferred of the present invention.
Figure 9:
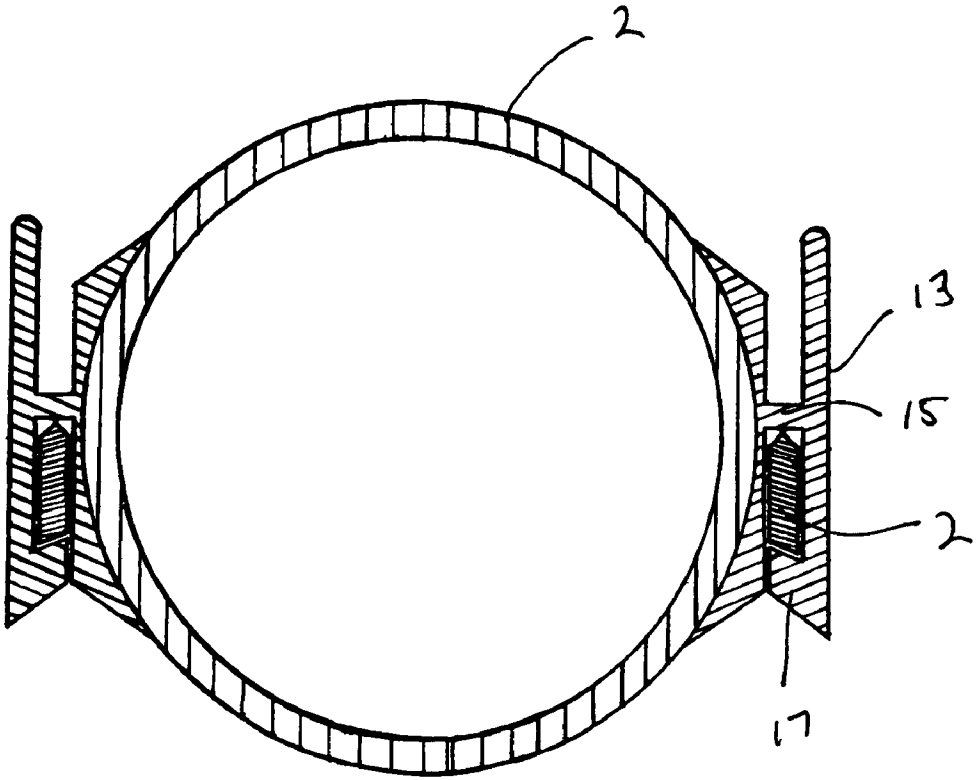
FIG. 9 is a sectional view taken along the line 9—9 of the FIG. 2.

In order to secure the blade portion in its pivoted or rotated position, foot engaging portion 2 may be fitted with a pair of clasps 13 that releasably secure the ends 14 of arm members 6 to the sides of the foot engaging portion. With arms 6 secured, clasps 13 will prevent further rotation or pivotal movement of the blade relative to foot engaging portion 2. FIGS. 9 and 9*a* show one of the possible configurations for clasps 13. Here the clasps are comprised of a generally T-shaped structure having a flexibly resilient medial wall 15 that permits the application of a force along one side of the clasp to allow the opposite side of the clasp to be displaced in an outward direction, providing an opening through which the ends 14 of arms 6 may pass and be received within a channel 16. When the ends of the arms are fully received within channel 16 the resiliency of medial wall 15 permits the clasp to return to its original position such that an inwardly directed flange 17 effectively encloses channel 16 and thereby securely holds arm member 6 in place. Releasing the arm member from channel 16 merely requires the application of force to the opposite side of clasp 13 causing a flexing of medial wall 15 and an "opening" of channel 16 to a point where the ends of the arm members may be rotated outwardly from their confined position. In the embodiment shown in FIGS. 9 and 9*a*, the leading edges 18 of arm members 6 contain tapered surfaces 19 to facilitate their entry into channel 16. The tapering of the edges of the arm members effectively allows them to be driven into clasps 13, causing medial wall 15 to flex and to thereby "open" channel 16.

To facilitate both the entry of foot engaging portion 2 between arm members 6 and the securement of the blade portion to the foot engaging portion, arm members 6 are preferably flexibly resilient and laterally displacable from the foot engaging portion. Displacing the arm members outwardly and away from the foot engaging position permits pins 11 to be releasably received within recesses 12. It is therefore expected that the arm members will be comprised of resilient synthetic material such as nylon, fibreglass, polyurethane, polyethylene or some other thermoplastic material. Of course arm members 6 could also be comprised of a combination of such products, or could be comprised of a softer rubber or plastic material having reinforcing ribs or other structural members embedded therein or attached thereto. Alternately, arm members 6 could be metallic or formed from a rigid material, in which case their "flexibility" would largely reside in their connection to the web portion of the blade and the inherent flexibility and resiliency of the materials from which the web is formed. In any case, it will be appreciated by those skilled in the art that arms 6 should be constructed in a fashion, or from a particular material or combination of materials, that permits them to be displaced laterally outward to a point that allows pins 11 to be received within recesses 12. Thereafter the resiliency of the arms allow them to move laterally inward toward the foot engaging portion to securely hold the pins within the recesses.

Figure 3:
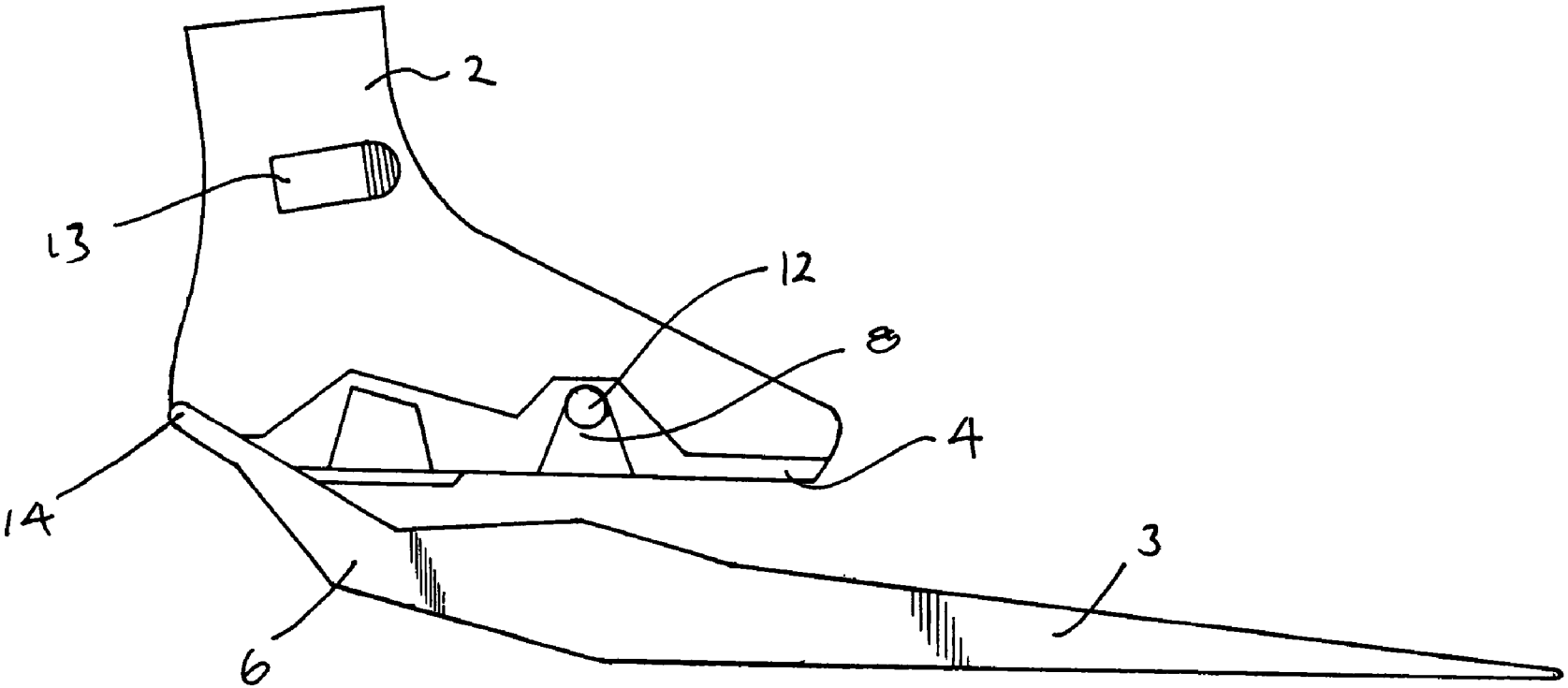
FIG. 3 is a side elevational view of the swim fin shown in FIG. 1 with the blade portion detached therefrom.
Figure 6:
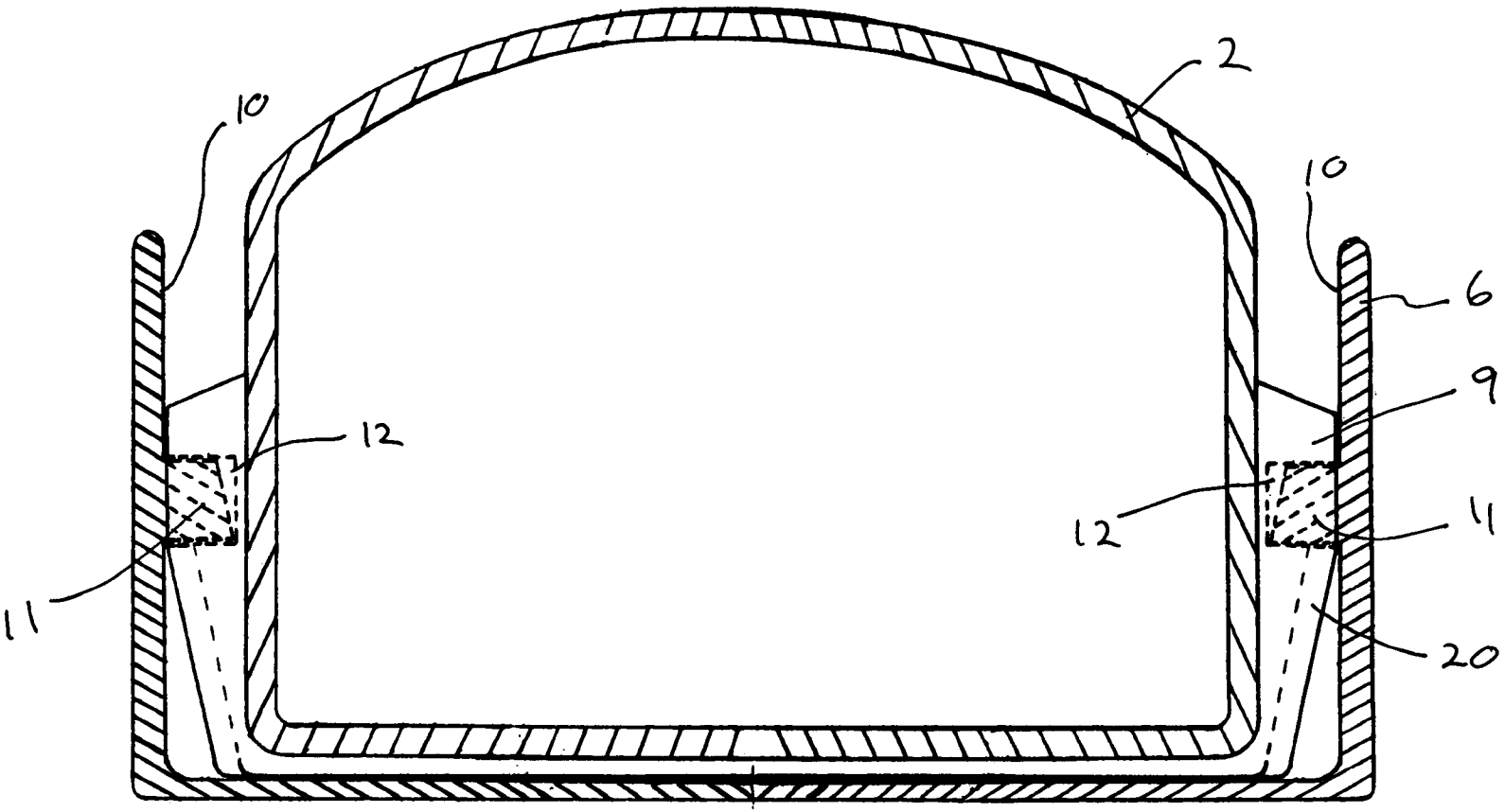
FIG. 6 is a sectional view taken along the line 6—6 of FIG. 1.
Figure 7:
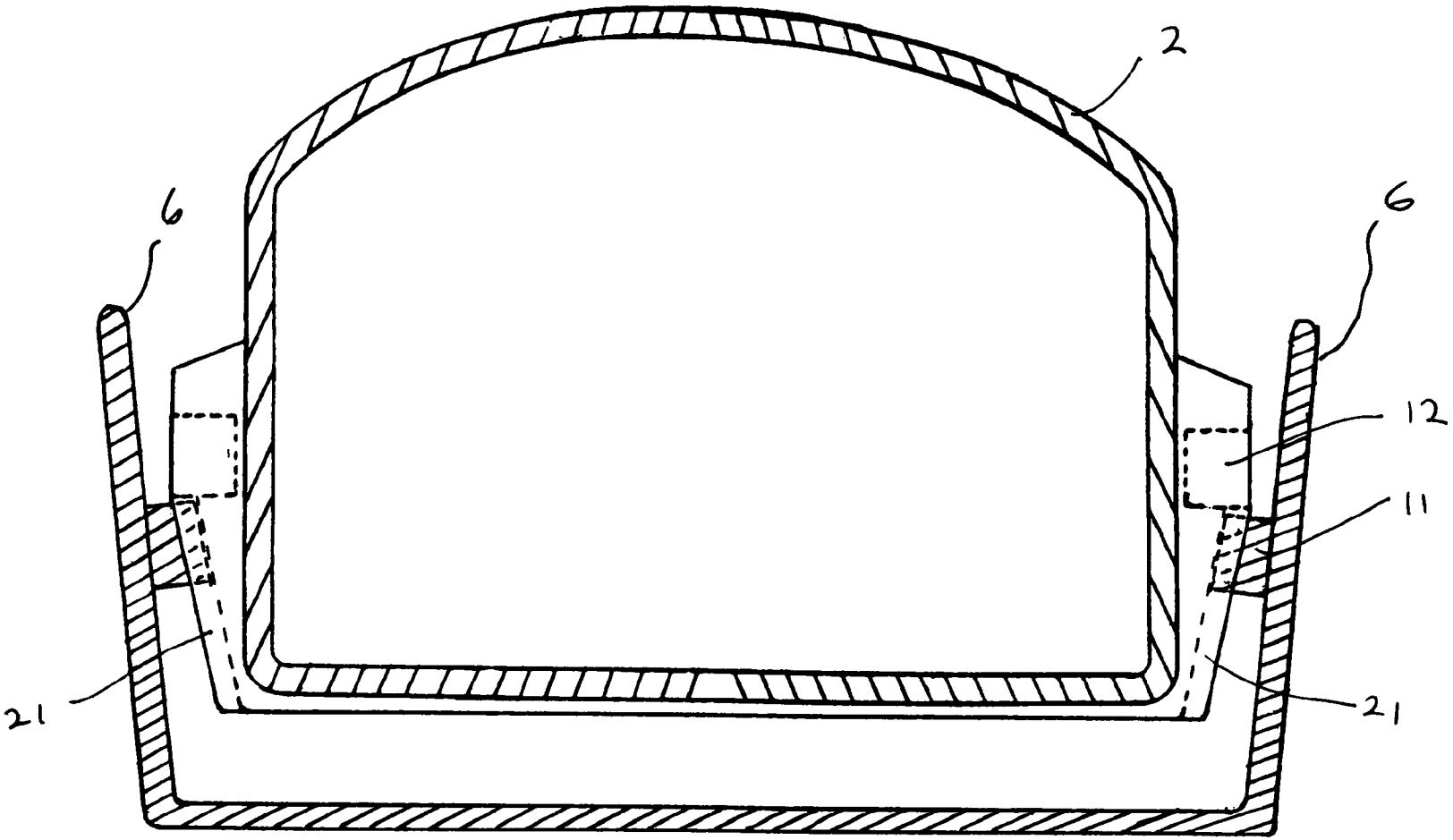
FIG. 7 is a view similar to FIG. 6 wherein the blade portion is shown as partially detached from the boot portion.

In an effort to simplify the use of swim fin 1, and to make it easier for blade portion 3 to be releasably secured to foot engaging portion 2, one version of the present invention allows the blade portion to be secured to the foot engaging portion by means of a step-in, hands free, entry. To this end, second latching members 8 on foot engaging portion 2 include a vertically oriented ramp 20. Ramp 20 is configured such that movement of foot engaging portion 2 vertically downward between arm members 6 causes pins 11 to be received against the sides of the ramp and horizontally displaced in an outward direction. As the foot engaging portion is driven downwardly the arms and pins will be progressively pushed out in a horizontal manner until pins 11 are in alignment with recesses 12, at which point the resiliency of the arm members will allow the pins to snap into place within their respective recesses. Preferably ramps 20 include a guide channel 21 that helps to guide and direct pins 11 into recesses 12 as the foot engaging portion is pushed downward. Removal of pins 11 from recesses 12 to allow for the blade to be removed from foot engaging portion 2 merely requires the application of a horizontally outwardly directed force to the arm members to permit pins 11 to be released from within the recesses. FIGS. 3, 6 and 7 show the blade portion 3 in various states of engagement with foot engaging portion 2. As indicated in FIGS. 6 and 7, the inner ends 22 of pins 11 may be vertically sloped or inclined such that their surfaces generally match the inclined surface of ramp 20. This sloping of the face of the pins will facilitate the interaction between the pins and the ramps and permit the foot engaging portion to be more easily received between the arms. It should also be noted that the relative positions of the pins, recesses and ramps on arms 6 and foot engaging portion 2 may be reversed or utilized in different combinations from that as described above.

Figure 10:
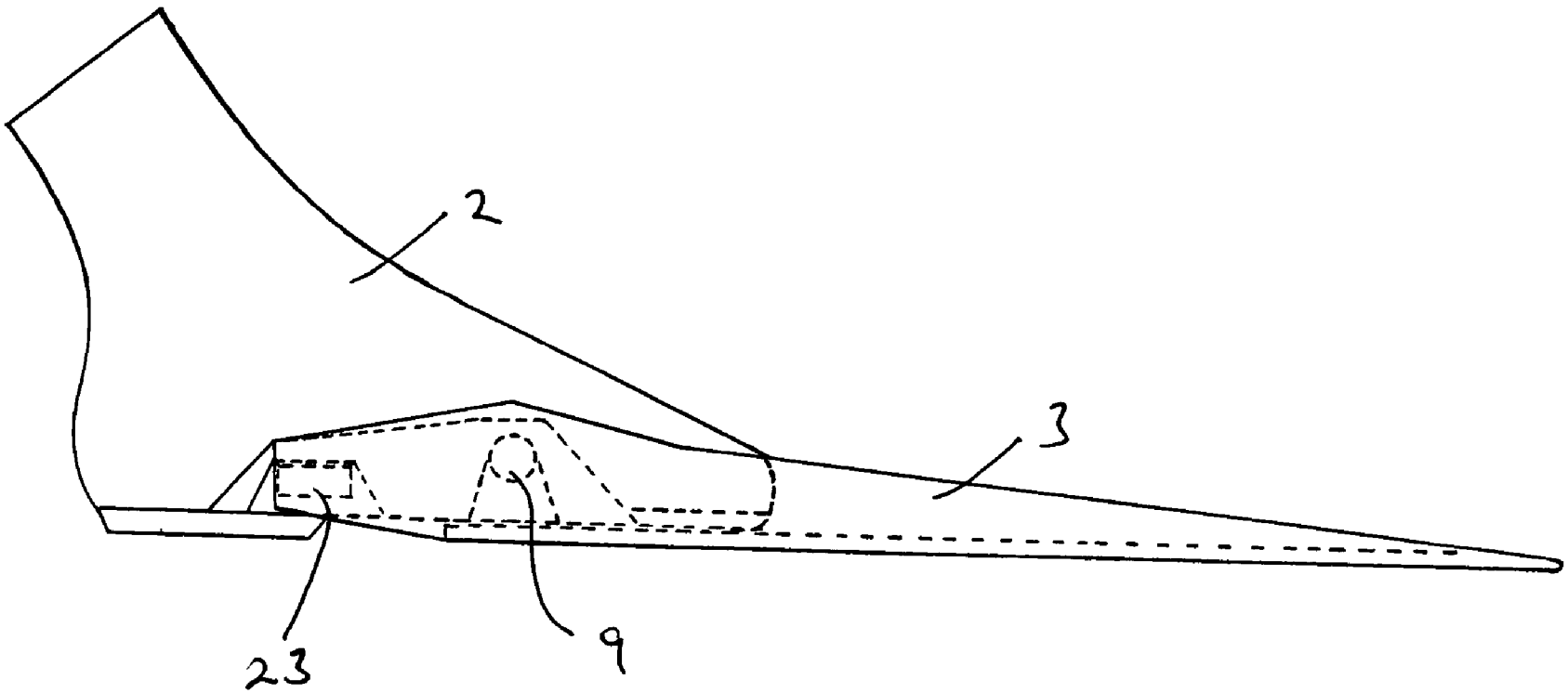

It will be appreciated by those skilled in the art that the above described manner of releasably securing the blade portion of a swim fin to its foot engaging portion may be utilized regardless of whether the fin is of a configuration and structure that permits the blade to be rotated or pivoted. That is, the same manner of detachably securing the blade to the foot engaging portion of the swim fin may be incorporated into a standard fixed blade fin that does not rotate. FIG. 10 is an example of such a fin having a traditionally oriented, non-rotating, blade. In such instances a plurality of releasable latching mechanisms may be situated on each side of the foot engaging portion to securely hold and retain the blade in place. It will also be appreciated that where the blade portion is designed to rotate or pivot about the foot engaging portion of the swim fin, alternate mechanical structures or locking mechanisms could be incorporated into the design in order to retain the blade in either a traditional non-rotated, or in a rotated, position.

Figure 8:
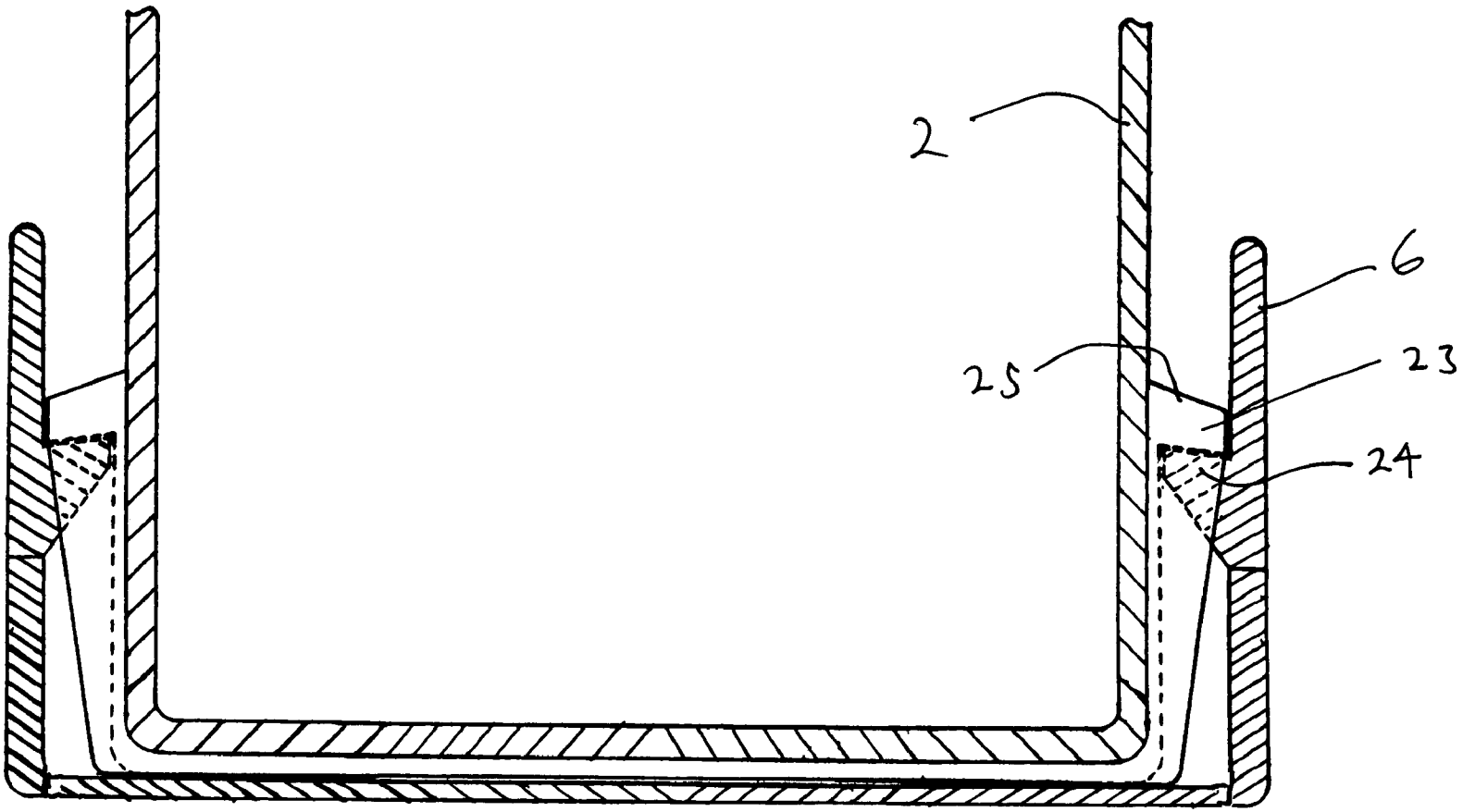
FIG. 8 is a sectional view taken along the line 8—8 of FIG. 1.

In one embodiment of the invention, and particularly in the embodiment where the blade portion is permitted to pivot or rotate about the foot engaging portion of the swim fin, fin 1 includes at least one second latching mechanism 23 on each side of foot engaging portion 2. Second latching mechanisms 23 provides additional assistance in helping to releasably secure arm members 6 to foot engaging portion 2. Where the structure is such that the blade is a pivoting or rotatable blade, second latching mechanisms 23 may also serve the further function of locking or holding the blade in a traditional, non-rotated, position such that it is maintained generally parallel to the bottom or sole of foot engaging portion 2. For example, in the version of swim fin 1 shown in the attached drawings (see FIG. 8) each of the second latching mechanisms 23 includes an inwardly and an outwardly directed flange, 24 and 25 respectively, with one of flanges 24 and 25 secured to foot engaging portion 2 and the other secured to one of the arm members 6. In FIG. 8 flange 24 is secured to arm member 6 with flange 25 fixed to the side of foot engaging portion 2, and preferably bottom or sole 4. In this manner, when foot engaging portion 2 is fully received between arms 6, the lower surface of flange 25 will contact the upper surface of flange 24, thereby preventing rotation of blade portion 3 about pins 11. To allow the blade to be rotated, the edges of the arm members may be grasped and pulled horizontally outward until the respective flanges clear one another, and thereby remove the restriction upon the rotational movement of the blade. Those having an appreciation of the invention will understand that there are an extremely wide variety of different mechanical structures that could be utilized for second latching mechanism 23 as a means to prevent the unintended rotational movement of blade portion 3. For example, the same type of pin and recess structure that comprises latching mechanism 9 could also be used in the case of second latching mechanism 23.

It is to be understood that what has been described are the preferred embodiments of the invention and that it may be possible to make variations to these embodiments while staying within the broad scope of the invention. Some of these variations have been discussed while others will be readily apparent to those skilled in the art.

I claim:

1. A swim fin comprising a foot engaging portion and a blade portion, said blade portion including one or more first latching members and said foot engaging portion including one or more second latching members, said first and said second latching members together forming one or more releasable latching mechanisms permitting said blade portion to be releasably secured to said foot engaging portion, said blade portion including a pair of arm members, each of said arm members received about opposite sides of said foot engaging portion when said blade portion is secured to said foot engaging portion, each of said arm members having attached thereto at least one of said first latching members, said first latching members comprised of one or more inwardly directed pins, posts or flanges, each side of said foot engaging portion having attached thereto at least one of said second latching members, said second latching members comprised of one or more outwardly extending open recesses, said arm members being flexibly resilient and laterally displaceable from said sides of said foot engaging portion to permit said one or more pins, posts or flanges to be releasably received within said one or more recesses, said recesses positioned and dimensioned so as to receive said one or more inwardly directed pins, posts or flanges of said first latching members when said blade portion is releasably secured to said foot engaging portion such that when said arm members are received about opposite sides of said foot engaging portion said first latching members and said second latching members on each respective side of said foot engaging portion are releasably engageable to form said releasable latching mechanisms and to thereby releasably secure said blade portion to said foot engaging portion.

2. The device as claimed in claim 1 wherein said second latching members include a ramp, said ramp causing a horizontally outward displacement of said arm members, and said first latching members attached thereto, upon the insertion of said foot engaging portion between said arm members thereby facilitating the receipt of said one or more pins, posts or flanges within said one or more recesses.

3. The device as claimed in claim 2 wherein said ramps include a guide channel to help guide said one or more pins, posts or flanges of said first latching members into said recesses of said second latching members.

4. The device as claimed in claim 1 including at least two first latching members on each of said arm members and at least two corresponding second latching members on each side of said foot engaging portion, said first and said second latching members together forming at least two releasable latching mechanisms on each side of said foot engaging portion when said blade portion is releasably secured to said foot engaging portion.

5. A swim fin comprising:

(i) a foot engaging portion;

(ii) a blade having a pair of arms, said arms releasably securable to opposite sides of said foot engaging portion; and, (iii) first and second latching mechanisms on each side of said foot engaging portion, said latching mechanisms releasably securing each of said arms of said blade to opposite sides of said foot engaging portion, each of said second latching mechanisms includes an inwardly and an outwardly directed flange, one of said inwardly and said outwardly directed flanges secured to said foot engaging portion and the other of said inwardly and said outwardly directing flanges secured to one of said arms of said blade.

6. The device as claimed in claim 5 wherein said first latching mechanisms include first and second latching members, said first latching members comprised of one or more pins, posts or flanges and said second latching members comprised of one or more recesses dimensioned to receive said one or more pins, posts or flanges when said blade is detachably secured to said foot engaging portion.

7. The device as claimed in claim 6 wherein said first latching members are positioned on said arms of said blade and comprise one or more inwardly directed pins, posts or flanges.

8. The device as claimed in claim 7 wherein said second latching members are positioned on opposite sides of said foot engaging portion and comprise outwardly extending open recesses to receive said first latching members.

9. The device as claimed in claim 5 wherein said first latching mechanisms provide a rotatable connection between said arms of said blade and said opposite sides of said foot engaging portion and permit said blade to rotate relative to said foot engaging portion.

10. The device as claimed in claim 5 wherein said inwardly and said outwardly directed flanges are releasably engagable such that when said first latching mechanism releasably secures said blade to said foot engaging portion said flanges are releasably engagable to prevent the rotation of said blade relative to said foot engaging portion, and releasably disengagable to permit rotation of said blade about said foot engaging portion.

11. The device as claimed in claim 5 wherein said first and said second latching mechanisms are compression activated permitting said blade portion to be releasably secured to said foot engaging portion through the vertical movement of said foot engaging portion between said arms of said blade portion.

12. The device as claimed in claim 6 wherein said second latching members include a ramp, said ramp causing a horizontally outward displacement of said arms upon the insertion of said foot engaging portion therebetween to facilitate the receipt of said one or more pins, posts or flanges within said recesses.

13. The device as claimed in claim 12 wherein said ramps include a guide channel to help guide said one or more pins, posts or flanges into said recesses.

14. A swim fin comprising:

(i) a foot engaging portion;

(ii) a blade having a pair of arms, said arms releasably securable to said foot engaging portion; and, (iii) a pair of first and second latching members releasably engagable to secure said arms of said blade to said foot engaging portion, said first latching members comprising one or more pins, posts or flanges and said second latching members comprising one or more recesses dimensioned to receive said one or more pins, posts or flanges when said blade is detachably secured to said foot engaging portion, said second latching members further including a ramp, said ramp causing a horizontally outward displacement of said arms upon the insertion of said foot engaging portion therebetween to facilitate the receipt of said one or more pins, posts or flanges within said recesses.

* * * * *